US005404213A

United States Patent [19]

Okano et al.

[11] Patent Number: 5,404,213

[45] Date of Patent: Apr. 4, 1995

[54] ELECTROPHOTOGRAPHIC PRINTING APPARATUS CAPABLE OF PRINTING IMAGES BY ELECTROPHOTOGRAPHIC PROCESSING AND ITS START-UP METHOD

[75] Inventors: Yoshiaki Okano; Kouichirou Satou; Tetsuya Nakamura, all of Tokyo, Japan

[73] Assignee: Kabushiki Kaisha Toshiba, Kawasaki, Japan

[21] Appl. No.: 216,370

[22] Filed: Mar. 23, 1994

Related U.S. Application Data

[63] Continuation of Ser. No. 844,435, Mar. 2, 1992, abandoned.

[30] Foreign Application Priority Data

| | | | |
|---|---|---|---|
| Mar. 4, 1991 | [JP] | Japan | 3-037487 |
| Mar. 6, 1991 | [JP] | Japan | 3-039819 |
| Mar. 28, 1991 | [JP] | Japan | 3-064530 |

[51] Int. Cl.[6] ..... G03G 15/06

[52] U.S. Cl. ..... 355/265; 355/246; 355/274

[58] Field of Search ..... 355/208, 219, 228, 233, 355/245, 246, 259, 261, 264, 265, 271, 274, 277

[56] References Cited

U.S. PATENT DOCUMENTS

| | | | |
|---|---|---|---|
| Re. 30,477 | 1/1981 | Gardiner et al. | 355/264 X |
| Re. 31,707 | 10/1984 | Miyakawa et al. | 355/264 |
| 3,892,481 | 7/1975 | Schaefer et al. | 355/264 |
| 4,814,816 | 3/1989 | Idenawa | 118/657 X |
| 5,003,353 | 3/1991 | Nitta | 355/265 |
| 5,032,870 | 7/1991 | Yui et al. | 355/219 |
| 5,047,804 | 9/1991 | Komura | 355/246 |
| 5,068,691 | 11/1991 | Nishio et al. | 355/259 |
| 5,146,601 | 9/1992 | Hosaka et al. | 355/208 X |
| 5,155,533 | 10/1992 | Kurokawa et al. | 355/246 |
| 5,161,084 | 11/1992 | Morihara et al. | 355/208 X |
| 5,164,746 | 11/1992 | Nishioka | 355/245 X |
| 5,164,783 | 11/1992 | Taguchi et al. | 355/327 |

*Primary Examiner*—Leo P. Picard
*Assistant Examiner*—Christopher Horgan
*Attorney, Agent, or Firm*—Finnegan, Henderson, Farabow, Garrett & Dunner

[57] ABSTRACT

To prevent spurious adherence of toner to the surface of a photosensitive drum during start-up of an electrophotographic printing apparatus, once rotation of the drum and charging of the drum surface to a predetermined potential are initiated, rotation of a developing roller to bring toner into contact with the drum surface is delayed until the charged portion of the drum surface has been rotated around to a position facing the developing roller. Applications of appropriately timed biasing voltages to the developing roller and an image transfer roller are also utilized to prevent spurious toner attraction to the surfaces of the drum and the transfer roller.

9 Claims, 8 Drawing Sheets

ELECTROPHOTOGRAPHIC PRINTING APPARATUS CAPABLE OF PRINTING IMAGES BY ELECTROPHOTOGRAPHIC PROCESSING AND ITS START-UP METHOD

This application is a continuation of application Ser. No. 07/844,435, filed Mar. 2, 1992, now abandoned.

BACKGROUND OF THE INVENTION

1. Field of the Invention

This invention relates to an electrophotographic printing apparatus capable of printing images by electrophotographic processing and a method of starting up this apparatus.

2. Description of the Related Art

Electrophotographic printing apparatuses print an image by processing a single photosensitive object primarily through charging, exposure, development, and transfer, which constitute an important part of electrophotographic processing.

Electrophotographic printing apparatuses generally use a photosensitive drum as a photosensitive object. Along the periphery of this photosensitive drum, a charging device, an exposure device, a development device, and a transfer device are arranged sequentially to complete the printing apparatus.

In the electrophotographic printing apparatus with this arrangement, the photosensitive drum undergoes a particular process, passing under each device, with the result that it is subjected to a series of electrophotographic processes during a drum revolution. Specifically, the charging device charges the surface of the photosensitive drum (the photosensitive surface) to, for example, −500 V. Then, the exposure device exposes the charged photosensitive surface according to an image to be printed. As a result of this, an electrostatic latent image is formed on the photosensitive surface of the drum. The development device develops this electrostatic image as follows, for example. A cylindrical development sleeve holds charged toner of the same polarity as that of the charged potential of the photosensitive drum, and permits the toner to come into contact with the photosensitive surface of the drum as it rotates. Here, by applying a development bias to the development sleeve, the bias being of the same polarity as that of the charged potential of the photosensitive drum and lower in voltage (for example, −200 V), the interaction between the electrostatic image and the development bias allows the toner to selectively adhere to the photosensitive drum. That is, toner does not adhere to the charged portions on the drum because the drum is at a higher potential, whereas it adheres to the exposure-discharged portions because the drum is at a lower potential. As a result, a toner image is formed on the photosensitive surface of the drum.

Then, printing paper is placed on the photosensitive surface of the drum. The transfer device supplies to the printing paper charges of the opposite polarity to that of the toner (for example, +500 V). As a consequence, the toner attaching to the photosensitive surface of the drum adheres to the printing paper, causing the toner image to be transferred to the paper. After this, the cleaning device removes the residual toner from the surface of the photosensitive drum.

When the electrophotographic printing apparatus thus constructed is not in operation, the potential of the surface of the photosensitive drum is indefinite. With the photosensitive drum at an indefinite potential, when the drum passes under the development device at the start of printing, toner adheres to the portions of lower voltages. To avoid this, the charging device is caused to start charging at the same time that the photosensitive drum starts rotating in order to minimize indefinite potential portions on the photosensitive surface of the drum.

However, when the drum is not in motion, the area between the charging position under the charging device and the development position under the development device cannot be charged, permitting toner to adhere to the area. The toner thus adhering to the photosensitive drum is collected by the cleaning device as waste toner, resulting in a waste of toner. In the transfer device that has a portion making contact with the photosensitive drum, such as a roller or brush, the toner first adhering to the drum adheres to the transfer device. The toner attaching to the transfer device then adheres to the back of the printing paper as the paper passes through between the photosensitive drum and the transfer device, smearing the back of the paper. Further, changes in the electric characteristics of the roller and brush lead to decreased transfer efficiency, causing poor transfer.

SUMMARY OF THE INVENTION

The object of the present invention is to minimize wasteful adhesion of developer to a photosensitive object in order to achieve economical and high-quality printing.

The foregoing object is accomplished by an electrophotographic printing apparatus comprising: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing an endless developer retaining object, located so as to face the surface of the photosensitive object, for retaining developer on its surface and bringing the retained developer into contact with the surface of the photosensitive object, retaining object rotating means for rotating the developer retaining object, and development electric field generating means for generating a development electric field between the photosensitive object and the developer retaining object to cause the developer to partially adhere to the photosensitive object according to the electrostatic latent image; transferring means, located so as to face the surface of the photosensitive object, for transferring the developer image formed on the photosensitive object to a specified printing medium; and control means for, when the photosensitive object rotating means has started rotating at least the photosensitive object, performing control in a manner that causes the charging means to start charging photosensitive object, and then reduces the amount of developer adhering to the area extending from the charging starting position of the photosensitive object facing the charging means at the start of charging by the charging means to the position of the photosensitive object facing the developing means at the start of rotation of the photosensitive object by the photosensitive object rotating means.

The foregoing object is also accomplished by an electrophotographic printing apparatus comprising: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing a endless developer retaining object, located so as to face the surface of the photosensitive object, for retaining developer on its surface and bringing the retained developer into contact with the surface of the photosensitive object, retaining object rotating means for rotating the developer retaining object, and first electric field generating means for generating a first electric field between the photosensitive object and the developer retaining object to cause the developer to partially adhere to the photosensitive object according to the electrostatic latent image; transferring means, located so as to face the surface of the photosensitive object, for transferring the developer image formed on the photosensitive object to a specified printing medium; second electric field generating means between the photosensitive object and the developer retaining object to attract the developer to the developer retaining object; and control means for, when the photosensitive object rotating means has started rotating the photosensitive object, performing control in a manner that causes the charging means to start charging the photosensitive object, and then allows the second electric field generating means to generate the second electric field until the charging starting position of the photosensitive object facing the charging means at the start of charging by the charging means has passed the position facing the developing means and, after the charging starting position has passed the position facing the developing means, allows the first electric field generating means to generate the first electric field.

The foregoing object is further accomplished by an electrophotographic printing apparatus comprising: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing an endless developer retaining object, located so as to face the surface of the photosensitive object, for retaining developer on its surface and bringing the retained developer into contact with the surface of the photosensitive object, retaining object rotating means for rotating the developer retaining object, and development electric field generating means for generating a development electric field between the photosensitive object and the developer retaining object to cause the developer to partially adhere to the photosensitive object according to the electrostatic latent image; transferring means, located so as to face the surface of the photosensitive object, for transferring the developer image formed on the photosensitive object to a specified printing medium; a retaining object moving mechanism for separating the developer retaining object from the photosensitive object; and control means for, when the photosensitive object rotating means has started rotating the photosensitive object, performing control in a manner that cause the charging means to start charging the photosensitive object, and then causes the retaining object moving mechanism to separate the developer retaining object from the photosensitive object until the charging starting position of the photosensitive object facing the charging means at the start of charging by the charging means has passed at least the position facing the developing means and, after the charging starting position has passed the position facing the developing means, causes the retaining object moving mechanism to bring the developer retaining object near the photosensitive object.

The foregoing object is achieved by a method of starting up an electrophotographic printing apparatus that comprises: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing an endless developer retaining object, located so as to face the surface of the photosensitive object, for retaining developer on its surface and bringing the retained developer into contact with the surface of the photosensitive object, retaining object rotating means for rotating the developer retaining object, and development electric field generating means for generating a development electric field between the photosensitive object and the developer retaining object to cause the developer to partially adhere to the photosensitive object according to the electrostatic latent image; and transferring means, located so as to face the surface of the photosensitive object, for transferring the developer image formed on the photosensitive object to a specified printing medium; comprising the steps of: causing the charging means to start charging the photosensitive object when the photosensitive object rotating means has started the photosensitive object; and performing control in a manner that reduces the amount of developer adhering to the area extending from the charging starting position of the photosensitive object facing the charging means at the start of charging by the charging means to the position of the photosensitive object facing the developing means at the start of rotation of the photosensitive object by the photosensitive object rotating means.

The foregoing object is also achieved by a method of starting up an electrophotographic printing apparatus that comprises: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing an endless developer retaining object, located so as to face the surface of the photosensitive object, for retaining developer on its surface and bringing the retained developer into contact with the surface of the photosensitive object, retaining object rotating means for rotating the developer retaining object, and first electric field generating means for generating a first electric field between the photosensitive object and the developer retaining object to cause the developer to partially adhere to the photosensitive object according to the electrostatic latent image; transferring means, located so as to face the surface of the photosensitive object, for transferring the developer image formed on the photosensitive object to a specified printing medium; and second electric field generating means for generating a second electric field between the photosensitive object and the developer retaining object to attract the developer to the developer retaining object; comprising the steps of: causing the charging means to start charging the photosensitive object when the photosensitive object rotating means has started the photosensitive object; allowing the second electric field generating means to generate the second electric field until the charging starting position of the photosensitive object facing the charging means at the start of charging by the charging means has passed at least the position facing the developing means; and allowing the first electric field generating means to generate the first electric field after the charging starting position has passed the position facing the developing means.

The foregoing object is further achieved by a method of starting up an electrophotographic printing apparatus that comprises: a photosensitive object formed by applying photoconductive material to the surface of an endless conductive substrate; photosensitive object rotating means for rotating the photosensitive object; charging means, located so as to face the surface of the photosensitive object, for charging the photosensitive object; exposing means, located so as to face the surface of the photosensitive object, for partially exposing the photosensitive object according to an image to be printed in order to form an electrostatic latent image on the surface of the photosensitive object; developing means for forming a developer image on the photosensitive object, the developing means containing an endless developer retaining object, located so as to face the surface of the photosensitive object, for retaining developer on its surface and bringing the retained developer into contact with the surface of the photosensitive object, retaining object rotating means for rotating the developer retaining object, and development electric field generating means for generating a development electric field between the photosensitive object and the developer retaining object to cause the developer to partially adhere to the photosensitive object according to the electrostatic latent image; transferring means, located so as to face the surface of the photosensitive object, for transferring the developer image formed on the photosensitive object to a specified printing medium; and retaining object moving mechanism for separating the developer retaining object from the photosensitive object; comprising the steps of: causing the charging means to start charging the photosensitive object when the photosensitive object rotating means has started the photosensitive object; causing the retaining object moving mechanism to separate the developer retaining object from the photosensitive object until the charging starting position of the photosensitive object facing the charging means at the start of charging by the charging means has passed at least the position facing the developing means; and causing the retaining object moving mechanism to bring the developer retaining object near the photosensitive object after the charging starting position has passed the position facing the developing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A first embodiment of the present invention will be explained, referring to the accompanying drawings.

Figure 1:
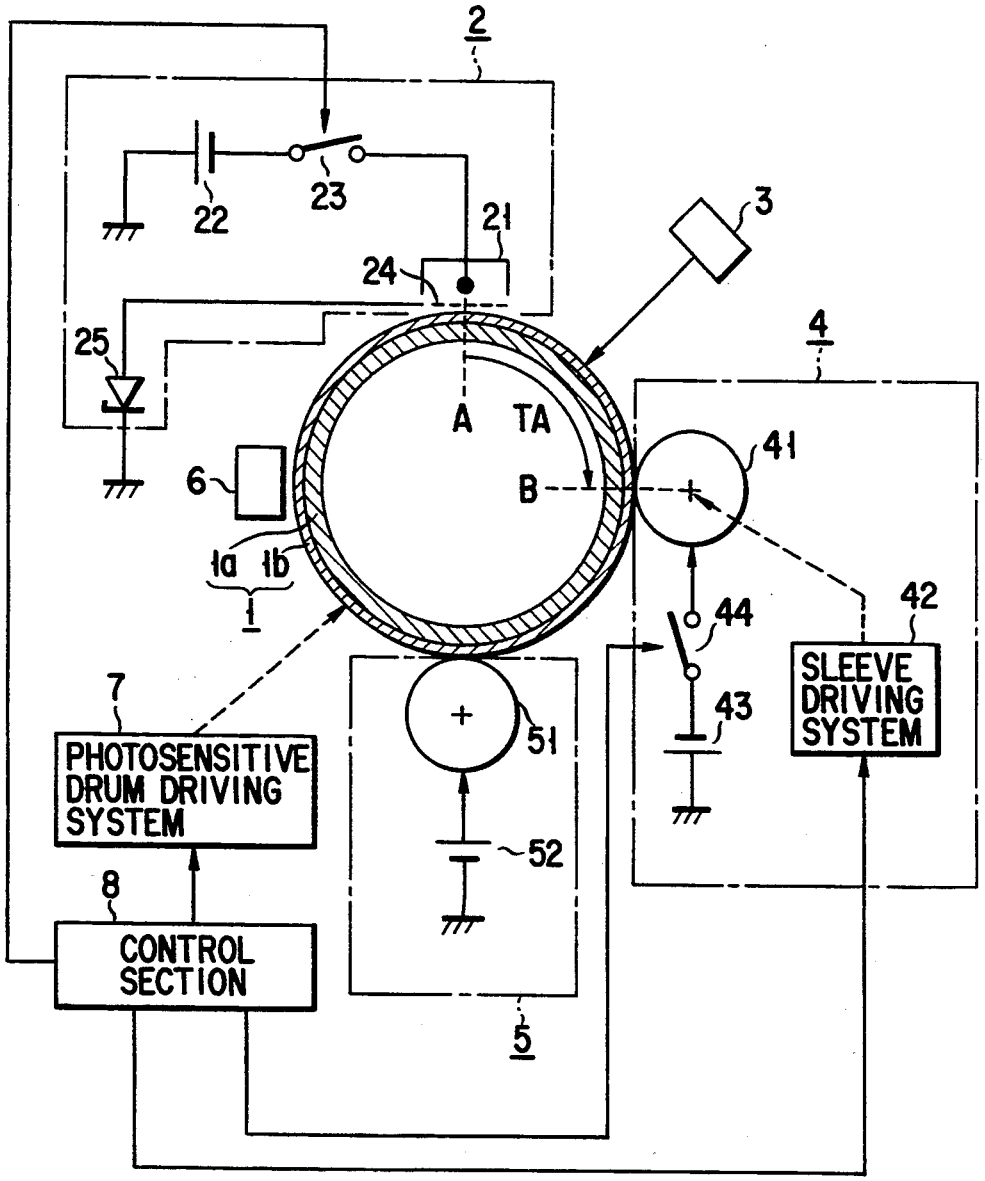
FIG. 1 is a schematic diagram of an electrophotographic printing apparatus according to a first embodiment of the present invention.

FIG. 1 schematically shows the construction of an electrophotographic printing apparatus according to the first embodiment, centering on major portions. This electrophotographic printing apparatus is composed of a photosensitive drum 1, a charging device 2, an exposure device 3, a development device 4, a transfer device 5, a cleaning device 6, a photosensitive drum driving system 7, and a control section 8.

The photosensitive drum 1 is constructed in such a manner that photoconductive material is applied to the outer periphery of an aluminum cylinder la to form a photoconductive layer lb. The charging device 2, exposure device 3, transfer device 5, and development device 4 are arranged in that order around the photosensitive drum 1 so as to face the outer periphery of the drum 1.

The charging device 2 is made up of a discharging unit 21, a high-voltage power supply 22, a switch 23, a grid 24, and a Zener diode 25, which are arranged so as to form a scorotron type charging device of a known construction.

The exposure device 3, which is composed of, for example, a laser scanner of a known construction, partially exposes the photosensitive drum 1 by projecting on it the laser beam modulated according to an image to be printed from a laser diode (not shown).

The development device 4 is made up of a development sleeve 41, a sleeve driving system 42, a development bias power supply 43, and a switch 44. The development sleeve 41 retains charged toner (not shown) of the same polarity (the negative polarity, in this case) as that of the charged potential of the photosensitive drum 1, and carries the toner as it is rotated by the sleeve driving system 42. The development sleeve 41, which is placed so as to face the photosensitive drum 1, brings the adhering toner into contact with the photosensitive drum 1. The development bias power supply 43 generates a development bias with the same polarity (the negative polarity, in this case) as that of the charged potential of the photosensitive drum 1 and lower (for example, −200 V) than this potential, and applies it to the development sleeve 41 via the switch 44. The switch 44 provides the ON/OFF control of application of the development bias to the development sleeve 41.

The transfer device 5 is composed of a transfer roller 51 and a high-voltage power supply 52. The transfer roller 51 is provided so as to press printing paper (not shown) against the photosensitive drum 1.

The high-voltage power supply 52 supplies to the transfer roller 51 a high voltage of the opposite polarity (the positive polarity, in this case) to that of the charged potential of the photosensitive drum 1.

The cleaning device 6, which has, for example, a blade brushing against the photosensitive drum 1, scrapes the toner from the photosensitive drum 1.

The photosensitive drum driving system 7, which is composed of, for example, a motor and gears, rotates the photosensitive drum 1.

The control section 8 supervises these starting timings: the starting timing for the photosensitive drum driving system 7 to rotate the drum 1; that for the charging device 2 to charge the photosensitive drum 1; that for the sleeve driving system 42 to rotate the development sleeve 41; and that for the development bias to be supplied to the development sleeve 41.

Figure 2:
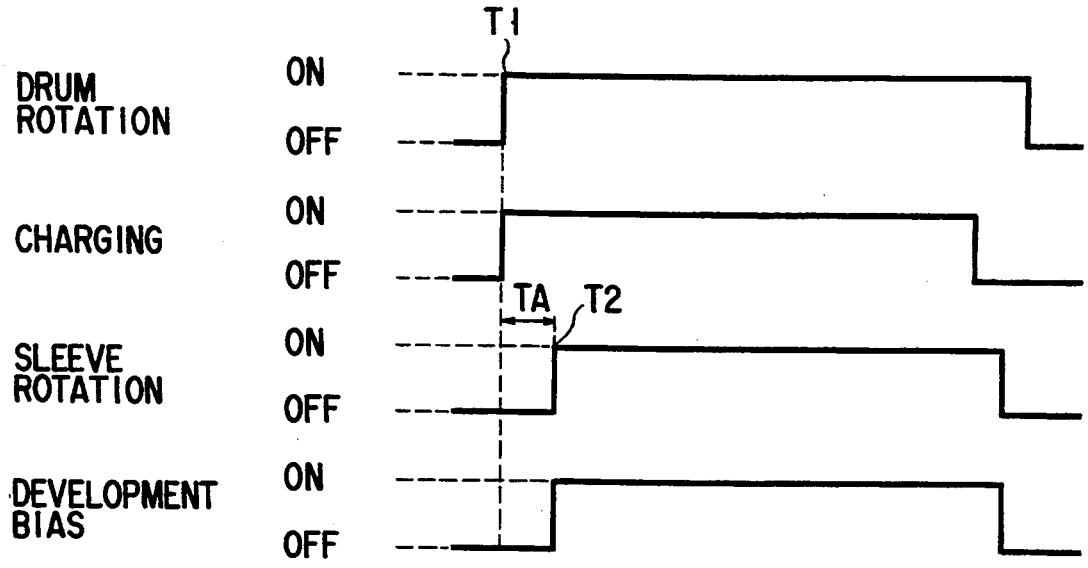
FIG. 2 is a timing chart of operation timings at primary portions of the electrophotographic printing apparatus of FIG. 1.

The operation of the electrophotographic printing apparatus thus constructed will be described in the order of control sequence of the control section 8. First, at the start of printing, the control section 8 permits the photosensitive drum driving system 7 to rotate the photosensitive drum 1. In response to this permission, the photosensitive drum driving system 7 starts to rotate the drum 1, which then begins to revolve (time T1 in FIG. 2).

The control section 8 turns on the switch 23 of the charging device 2 at the same time that it gives the photosensitive drum driving system 7 a permission to rotate the drum 1. In the charging device 2, as soon as the switch 23 has been turned on, a high voltage generated by the high-voltage power supply 22 is applied to the discharging unit 21, which then discharges to cause the surface of the photosensitive drum 1 to be charged. At this time, the charged potential of the drum 1 is kept at a constant breakdown voltage of the Zener diode 25 (at −500 V, in this case) by a combination of the grid 24 and Zener diode 25.

When a specified period of time TA has elapsed (time T2 in FIG. 2) since time T1 (the time required for a particular point on the drum 1 to move from charging position A under the charging device 2 to developing position B under the development device 4), the control section 8 instructs the sleeve driving system 42 to start rotating the development sleeve 41, and at the same time, turns on the switch 44. Accordingly, the development device 4 begins to operate at the time that a particular point on the drum 1 positioned at charging position A at the start of charging reaches developing position B. This allows a development bias produced by the development bias power supply 43 to be applied to the development sleeve 41.

After this, the exposure device 3 exposes the charged photosensitive surface of the drum 1 according to an image to be printed, thereby forming an electrostatic latent image on the photosensitive surface of the drum 1. The development device 4 then develops the electrostatic image on the photosensitive surface of the drum 1. This development is performed as follows, for example. The development sleeve 41 holds charged toner of the same polarity as that of the charged potential of the drum 1, and brings the toner into contact with the drum 1 as it rotates. At this time, the interaction between the electrostatic image and the development bias allows toner to selectively adhere to the photosensitive drum 1. Specifically, toner does not adhere to the charged portions on the photosensitive drum 1 because the photosensitive drum 1 is at a higher potential, whereas it adheres to the exposure-discharged portions because the drum 1 is at a lower potential. As a result, a toner image is formed on the photosensitive surface of the drum 1.

Then, printing paper (not shown) is inserted between the photosensitive drum 1 and the transfer roller 51. Here, a voltage (for example, +500 V) generated by the high-voltage power supply 52 with the opposite polarity to that of the potential of the toner, is supplied to the back of the printing paper via the transfer roller 51. This permits the toner adhering to the photosensitive surface of the drum 1 to be attracted electrostatically to the printing paper, with the result that the toner image on the drum 1 is transferred to the printing paper. After this, the cleaning device 6 removes the residual toner from the surface of the photosensitive drum 1.

As noted above, with the present embodiment, at the start of printing, the development sleeve 41 remains inoperative until the indefinite-voltage portions on the photosensitive drum has passed developing position B, which prevents toner from being supplied onto the photosensitive drum 1, thereby keeping toner from adhering to the drum 1 even when the potential of the drum 1 is lower. This eliminates a waste of toner and the smearing of the transfer roller 51.

The present invention is not limited to this embodiment. For example, the transfer device is not restricted to the roller type, but may be of the brush type or of the noncontacting type such as a discharging unit. The application of a negative voltage to the transfer roller is not always necessary and may be omitted. The body of the photosensitive drum 1 is not restricted to an aluminum cylinder, but may be a suitable matter as long as it is formed out of conductive material. The present invention may be practiced or modified in still other ways without departing from the spirit or essential character thereof.

A second embodiment of the present invention will be explained, referring to the accompanying drawings.

Figure 3:
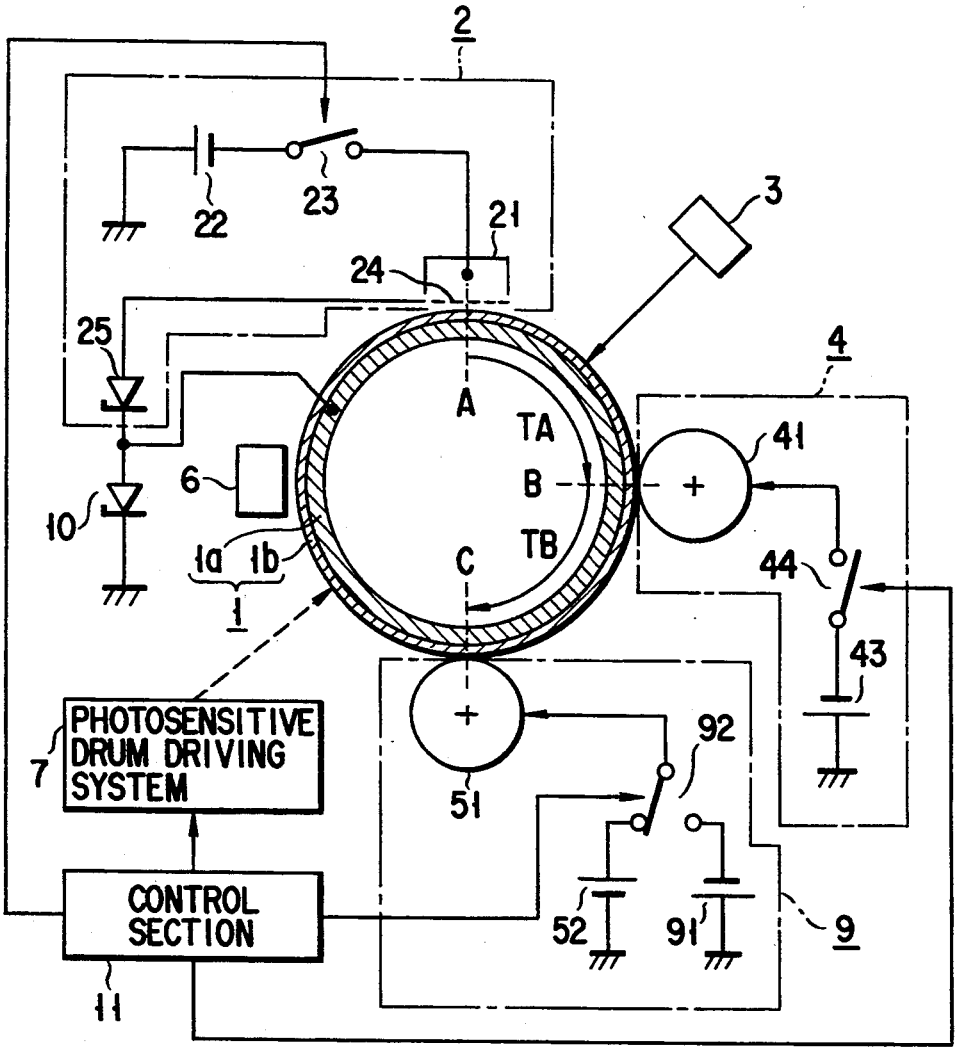
FIG. 3 is a schematic diagram of an electrophotographic printing apparatus according to a second embodiment of the present invention.

FIG. 3 is a schematic diagram of an electrophotographic printing apparatus of the second embodiment, centering on major portions. The same parts as those in FIG. 1 are indicated by the same reference characters, and their detailed explanations will be omitted.

This electrophotographic printing apparatus is composed of a photosensitive drum 1, a charging device 2, an exposure device 3, a development device 4, a cleaning device 6, a photosensitive drum driving system 7, a transfer device 9, a Zener diode 10, and a control section 11.

The transfer device 9 is made up of a transfer roller 51, a high-voltage power supply 52, a high-voltage power supply 91, and a switch 92. The transfer roller 51 is provided so as to press printing paper (not shown) against the photosensitive drum 1. The high-voltage power supply 52 produces a high voltage of the opposite polarity (the positive polarity, in this case) to that of the charged potential of the drum 1. The high-voltage power supply 91 generates a high voltage of the same polarity (the negative polarity, in this case) as that of the charged potential of the drum 1. The switch 92 provides ON/OFF control of application of a high voltage to the transfer roller 51 and determines which high voltage to be applied to this roller 51, a high voltage generated by the high-voltage power supply 51 or that by the high-voltage power supply 91.

The Zener diode 10 has its anode connected to both the cathode of the Zener diode 25 and the aluminum cylinder la of the photosensitive drum 1, and its cathode connected to the ground.

The control section 11 supervises the starting timing for the photosensitive drum driving system 7 to start to rotate the drum 1 and the ON/OFF timings of the switches 23, 44, and 92.

The operation of the electrophotographic printing apparatus thus constructed will be described in the order of control sequence of the control section 11. Here, it is assumed that on the photosensitive drum 1, the charging position under the charging device 7, the developing position under the development device 8, and the transferring position under the transfer device are point A, point B, and point C, respectively. It is also assumed that the times required for a particular point on the photosensitive drum 1 to move from points A to B and from points B to C are TA and TB, respectively.

Figure 4:
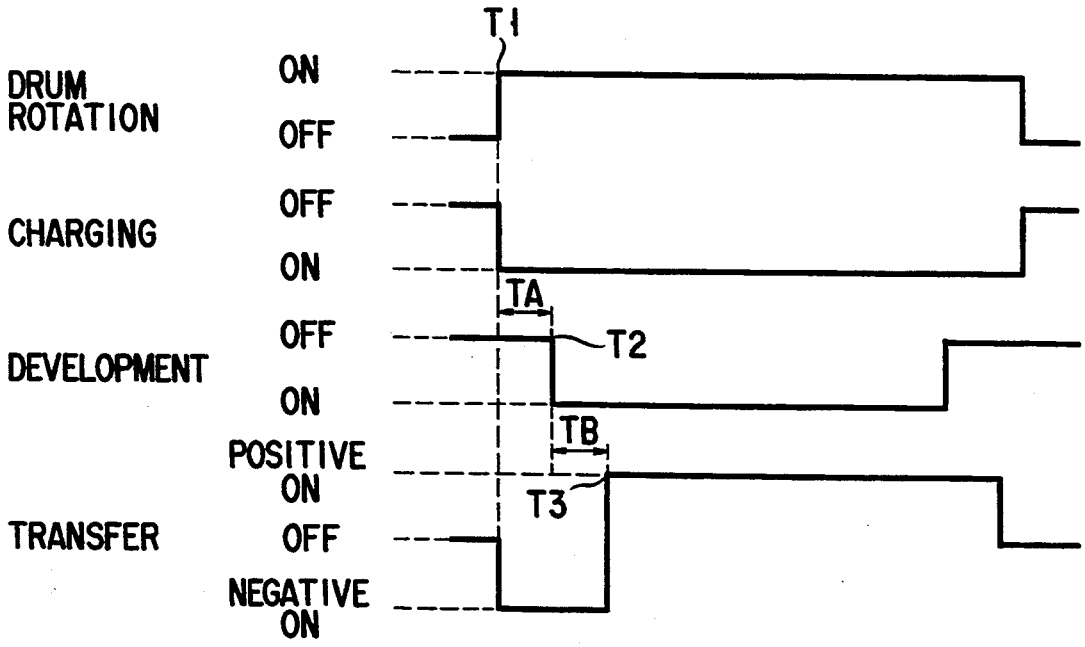
FIG. 4 is a timing chart of operation timings at primary portions of the electrophotographic printing apparatus of FIG. 3.

First, at the start of printing, the control section 11 permits the photosensitive drum driving system 7 to rotate the photosensitive drum 1. In response to this permission, the photosensitive drum driving system 7 starts to rotate the drum 1, which then begins to revolve (time T1 in FIG. 4).

The control section 11 also turns on the switch 23 of the charging device 2 at the same time that it gives the photosensitive drum driving system 7 a permission to rotate the drum 1. In the charging device 2, as soon as the switch 23 has been turned on, a high voltage generated by the high-voltage power supply 22 is applied to the discharging unit 21, which then discharges to cause the surface of the photosensitive drum 1 to be charged. At this time, the charged potential of the drum 1 is kept at a constant breakdown voltage of the Zener diode 25 (at −500 V, in this case) by a combination of the grid 24 and Zener diode 25.

The control section 11 also causes the switch 92 to switch to the high-voltage power supply 91 at the same time that it gives the above-described permission.

When a period of time TA has elapsed (time T2 in FIG. 4) since time T1, the control section 11 then turns on the switch 43 of the development device 4. That is, the switch 43 is turned on at the time when a particular point on the photosensitive drum 1 positioned at charging position A at the start of charging reaches developing position B. This allows a development bias (−200 V, in this case) generated by the high-voltage power supply 43 to be applied to the development sleeve 41.

In this case, during the interval from when the rotation of the drum 1 and the charging has been started until the switch is turned on, that is, before the indefinite-potential portions on the drum 1 located between charging position A and developing position B during the stop of the drum 1 has passed developing position B, the switch 43 remains in the OFF state, preventing the development bias from being applied to the development sleeve 41, with the result that the potential of the development sleeve 41 is at 0 V. On the other hand, because in the photosensitive drum 1, the aluminum cylinder la is connected to the ground via the zener diode 10, the potential of the cylinder la is at the breakdown voltage (−100 V, in this case) of the Zener diode 10. Here, it is assumed that the potential of the aluminum cylinder la is of the same polarity as that of the development bias and its absolute value is larger than zero but smaller than the absolute value of the development bias voltage. That is, in this embodiment, if the potential of the aluminum cylinder 1*a* is Vb, Vb will be in the range of $0 > Vb > -200$.

As described above, while the development sleeve 41 is at a potential of 0 V, even the lowest potential of the photosensitive drum 1 is as high as −100 V, meaning that the drum 1 is higher in potential than the sleeve 41. As a result of this, there is no forces on the drum that attract the toner retained by the development sleeve 41 to the photosensitive drum 1, preventing toner from adhering to the drum 1 even when the potential of the photosensitive drum 1 is indefinite.

When a period of time TB has elapsed (time T3 in FIG. 4) since time T2, the control section 11 causes the switch 92 of the transfer device 92 to the high-voltage power supply 52. Specifically, the switch 92 is switched to the high-voltage power supply 91 until the indefinite-potential portions on the drum 1 between charging position A and developing position B during the stop of the drum 1 have passed transferring position C, and from this point on, it is switched to the high-voltage power supply 52. As a consequence, a negative high-voltage generated by the high-voltage power supply 91 is applied to the transfer roller 51 until the indefinite-potential portions have passed transfer position C, and from this time on, a positive high-voltage (for example, +500 V) produced by the high-voltage power supply 52 is applied to the roller 51.

With the transfer roller 51 being applied with a positive high voltage, a similar mechanism to that in the first embodiment allows the transfer of toner onto the printing paper passing between the photosensitive drum 1 and the transfer drum 51. On the other hand, with the roller 51 being applied with a negative high voltage, the toner adhering to the drum 1 is repelled by the action of the negative high voltage, preventing the toner from adhering to the transfer roller 51. Consequently, even when toner physically attaches the drum 1 at the development device 4, the toner thus adhering to the drum 1 will not adhere to the transfer roller 51, preventing the transfer roller 51 from getting dirty.

As noted above, with the present embodiment, because the potential of the aluminum cylinder 1*a* of the drum 1 is of the same polarity as that of the development bias and its absolute value is larger than zero but smaller (−100 V) than the absolute value of the development bias voltage, and at the start of printing, the application of a development bias to the development sleeve 41 is suspended until the indefinite-potential portions on the drum 1 have passed developing position B, the potential of the drum 1 is always kept higher than that of the development sleeve 81, during this bias suspension, in spite of the indefinite potential of the drum 1, thereby preventing toner from adhering to the drum 1.

In this embodiment, because the high voltage applied to the transfer roller 51 is of the same polarity as that of the charged potential of the drum 1 until the indefinite-potential portions on the drum 1 have passed transferring position C, disabling the transfer roller 51 from transfer, even a trace of toner on the drum 1 will never adhere to the transfer roller 51, assuring perfect prevention of the smearing of the roller 51.

While in the embodiment, the charged potential, development bias, and transfer voltage are set at the same value as that of the aluminum cylinder la connected to the ground, it is desirable that they should be shifted by the amount of potential applied to the aluminum cylinder 1*a*. Specifically, if the potential of the aluminum cylinder 1*a* is −100 V as noted earlier, the charged potential should be −600 V, the development bias −300 V, and the transfer voltage +400 V.

In the embodiment, the interval during which a high voltage applied to the transfer roller 51 is of the opposite polarity to that of the transfer voltage is an interval from when the charging device 2 begins to charge until a period of time of TA+TB elapses. However, by setting the interval to a period of time from the start of the charging until the leading edge of the printing paper reaches transferring position C, it is also possible to prevent toner from adhering to the transfer roller 51 even when toner has adhered onto the charged photosensitive drum 1.

The present invention is not limited to this embodiment. For instance, the transfer device is not restricted to the roller type, but may be of the brush type or of the noncontacting type such as a discharging unit. The application of a negative voltage to the transfer roller is not always necessary and may be omitted. The body of the photosensitive drum 1 is not restricted to an aluminum cylinder, but may be a suitable matter as long as it is formed out of conductive material. The present invention may be practiced or modified in still other ways without departing from the spirit or essential character thereof.

A third embodiment of the present invention will be explained, referring to the accompanying drawings.

Figure 5:
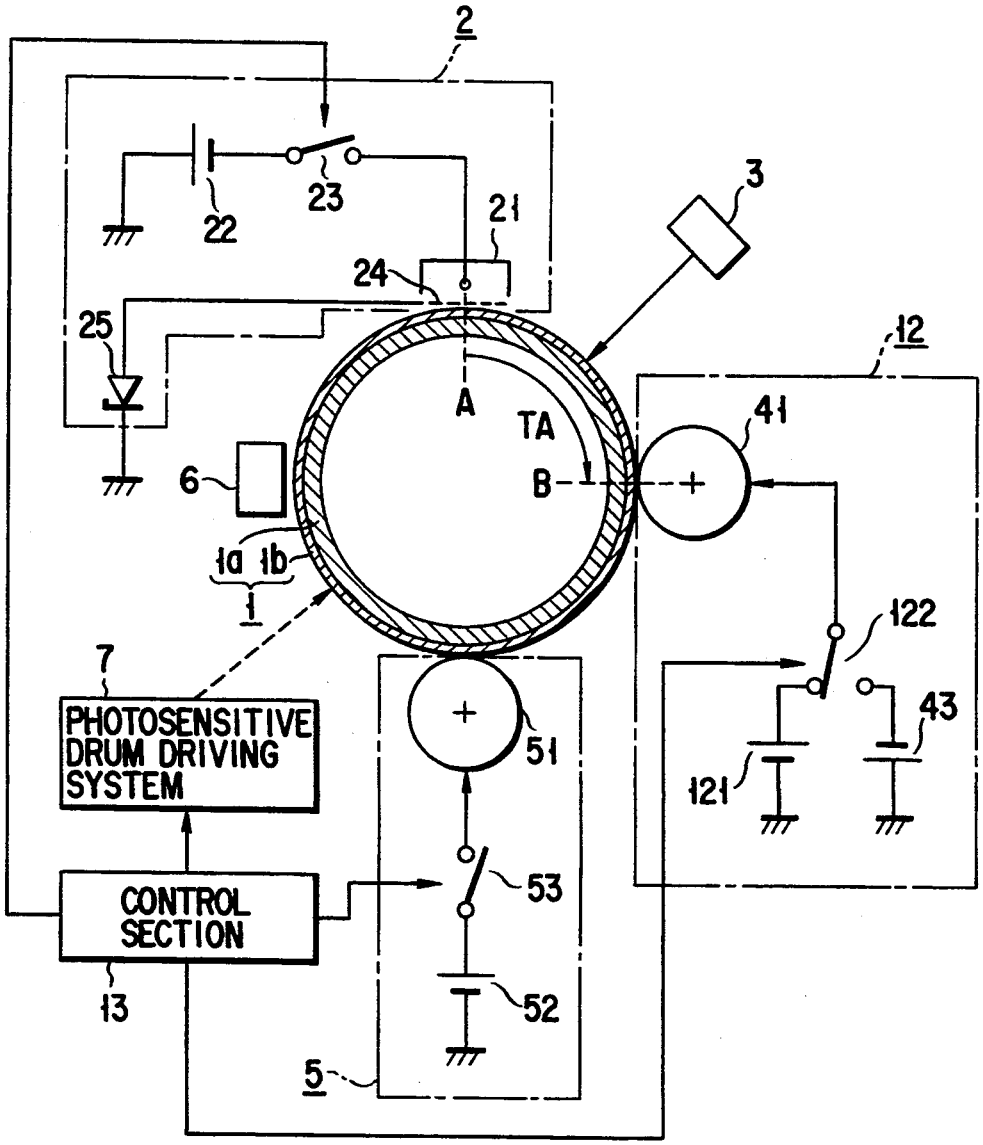
FIG. 5 is a schematic diagram of an electrophotographic printing apparatus according to a third embodiment of the present invention.

FIG. 5 is a schematic diagram of an electrophotographic printing apparatus of the third embodiment, centering on primary portions. The same parts as those in FIG. 1 are indicated by the same reference characters, and their detailed explanations will be omitted.

This electrophotographic printing apparatus is composed of a photosensitive drum 1, a charging device 2, an exposure device 3, a transfer device 5, a cleaning device 6, a photosensitive drum driving system 7, a development device 12, and a control section 13.

The development device 12 is made up of a development sleeve 41, a development bias power supply 43, a reverse bias power supply 121, and a switch 122. The reverse bias power supply 121 produces a reverse bias of the opposite polarity (the positive polarity, in this case) to that of the development bias generated by the development bias power supply 43. The switch 122 provides ON/OFF control of application of a voltage to the development sleeve 41 and determines which bias to be applied to this sleeve 41, the development bias or the reverse bias.

The control section 13 supervises the starting timing for the photosensitive drum driving system 7 to start rotating the drum 1 and the ON/OFF timings of the switches 23, 53, and 122.

The operation of the electrophotographic printing apparatus thus constructed will be described in the order of control sequence of the control section 13. Here, it is assumed that on the photosensitive drum 1, the charging position under the charging device 2 and the developing position under the development device 12 are point A and point B, respectively. It is also assumed that the time required for a particular point on the photosensitive drum 1 to move from point A to point B is TA.

Figure 6:
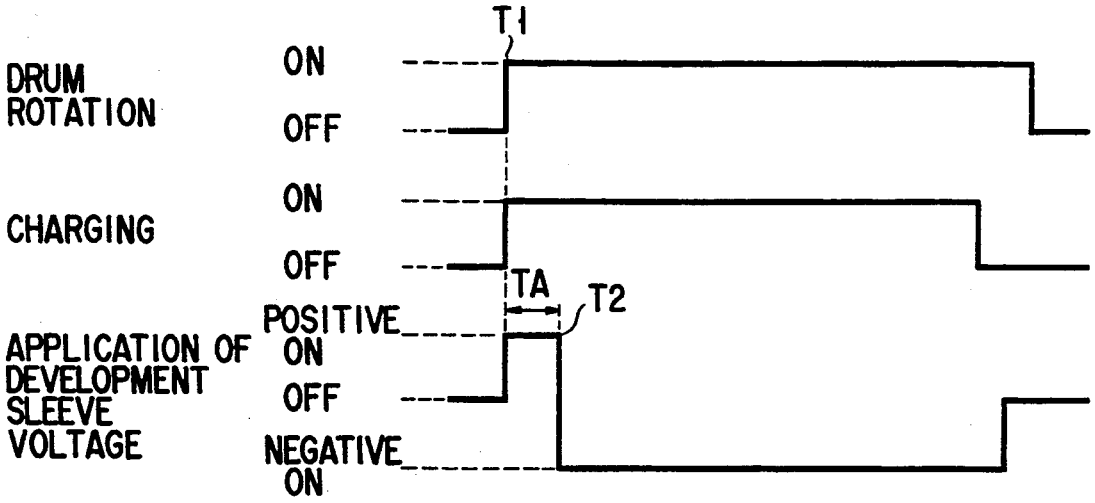
FIG. 6 is a timing chart of operation timings at primary portions of the electrophotographic printing apparatus of FIG. 5.

First, at the start of printing, the control section 13 permits the photosensitive drum driving system 7 to rotate the photosensitive drum 1. In response to this permission, the photosensitive drum driving system 7 starts to rotate the drum 1, which then begins to revolve (time T1 in FIG. 6).

The control section 13 also turns on the switch 23 of the charging device 2 at the same time that it gives the photosensitive drum driving system 7 a permission to rotate the drum 1. In the charging device 2, as soon as the switch 23 has been turned on, a high voltage generated by the high-voltage power supply 22 is applied to the discharging unit 21, which then discharges to cause the surface of the photosensitive drum 1 to be charged. At this time, the charged potential of the drum 1 is kept at a constant break down voltage of the Zener diode 25 (at −500 V, in this case) by a combination of the grid 24 and Zener diode 25.

At time T1, the control section 13 also causes the switch 122 to switch to the reverse bias power supply 121, thereby allowing the reverse bias with the positive polarity to be applied to the development sleeve 41. With the development sleeve 41 applied with the reverse bias, negatively charged toner is electrostatically attracted to the development sleeve 41.

When a period of time TA has elapsed (time T2 in FIG. 6) since time T1, the control section 12 then causes the selector switch 122 to switch to the development bias power supply 43, thereby permitting a negative development bias to be applied to the development sleeve 41. That is, the development bias is applied to the development sleeve 41 at the time when a particular point on the drum 1 positioned at charging position A at the start of charging reaches developing position B. From this time on, the printing operation is carried out according to the known electrophotographic processes as described in the first embodiment.

With the present embodiment, because, at the start of printing, a reverse bias is applied to the development sleeve 41 until the indefinite-potential portions on the photosensitive drum 1 have passed developing position B, toner is electrostatically attracted to the development sleeve 41 that then traps toner firmly during the interval of the reverse bias, thereby preventing toner from adhering to the photosensitive drum 1.

Consequently, toner will not be wasted and the transfer roller 51 is kept free from dirt.

The present invention is not limited to the previous embodiments. For instance, various requirements for the photosensitive drum 1, including the charged potential and the polarity, are not restricted to those used in the previous embodiments. The switching timings for applying a voltage to the development sleeve 41 and to the transfer roller 51 are not restricted to those explained in the previous embodiments, but may be any timings as long as they are after time T2 for the applied-voltage switching timing with the development sleeve 41, and after time T3 for the applied-voltage switching timing with the transfer roller 51. It is desirable that the applied-voltage switching timing with the transfer roller 51 should be set taking into account the timing that the printing paper reaches transferring position C.

The present invention may be practiced or modified in still other ways without departing from the spirit or essential character thereof.

A fourth embodiment of the present invention will be explained, referring to the accompanying drawings.

Figure 7:
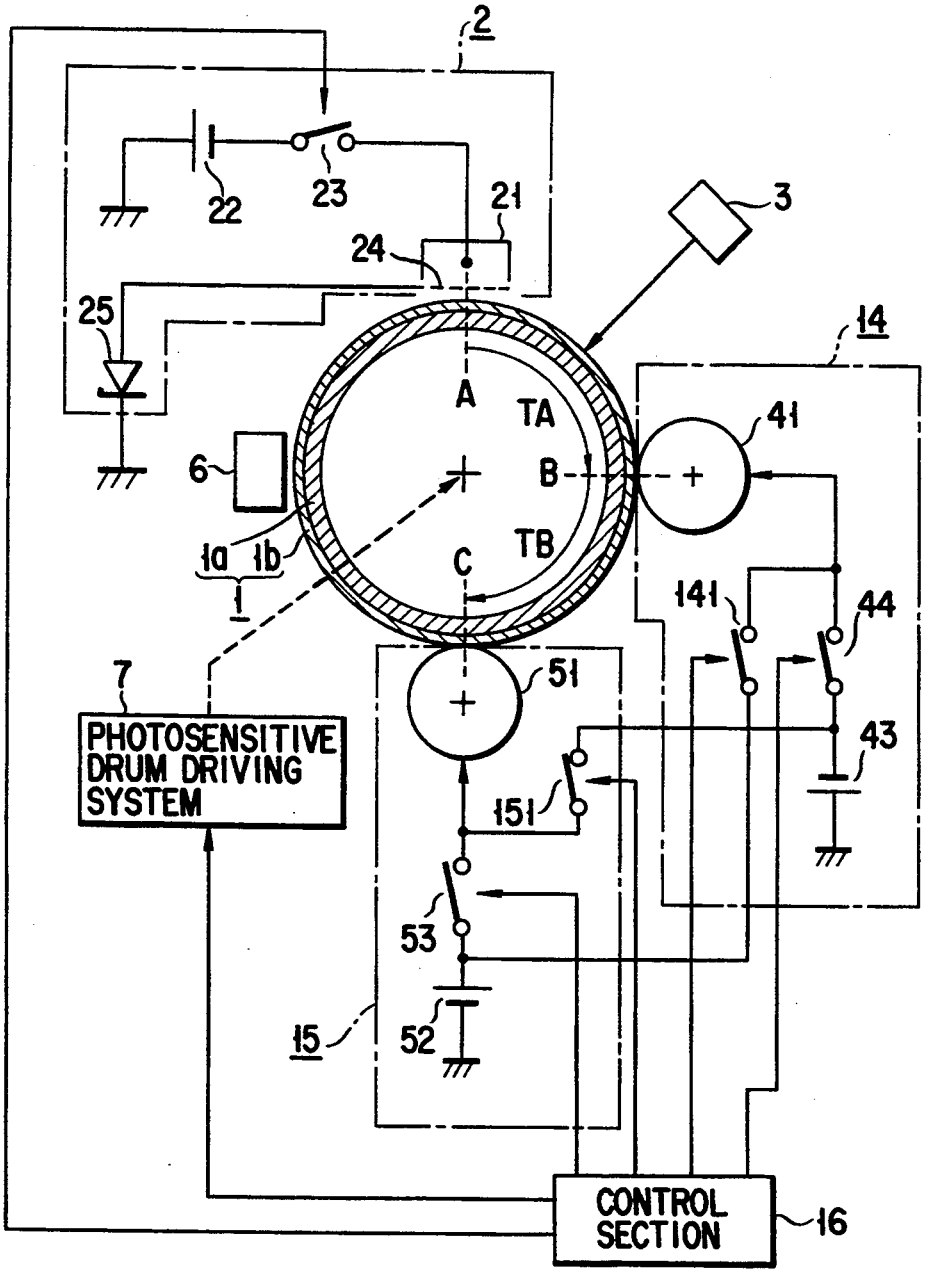
FIG. 7 is a schematic diagram of an electrophotographic printing apparatus according to a fourth embodiment of the present invention.

FIG. 7 is a schematic diagram of an electrophotographic printing apparatus of the fourth embodiment, centering on primary portions. The same parts as those in FIGS. 1 and 5 are indicated by the same reference characters, and their detailed explanations will be omitted.

This electrophotographic printing apparatus is composed of a photosensitive drum 1, a charging device 2, an exposure device 3, a cleaning device 6, a photosensitive drum driving system 7, a development device 14, a transfer device 15, and a control section 16.

The development device 14 is made up of a development sleeve 41, a development bias power supply 43, switches 44 and 141. The transfer device 15 contains a transfer roller 51, a high-voltage power supply 52, and switches 53 and 151.

The switch 141 of the development device 14 provides ON/OFF control of application of a transfer voltage generated by the high-voltage power supply 52 of the transfer device 15 to the development sleeve 41. The switch 151 of the transfer device 15 provides ON/OFF control of application of a development bias produced by the development-bias power supply 43 of the development device 14 to the transfer roller 51.

The control section 16 supervises the starting timing for the photosensitive drum driving system 7 to start rotating the drum 1 and the ON/OFF timings of the switches 23, 44, 53,141, and 151.

The operation of the electrophotographic printing apparatus thus constructed will be described in the order of control sequence of the control section 16. Here, it is assumed that on the photosensitive drum 1, the transferring position under the transfer device 15 is point C. It is also assumed that the time required for a particular point on the photosensitive drum 1 to move from point B to point C is TB.

Figure 8:
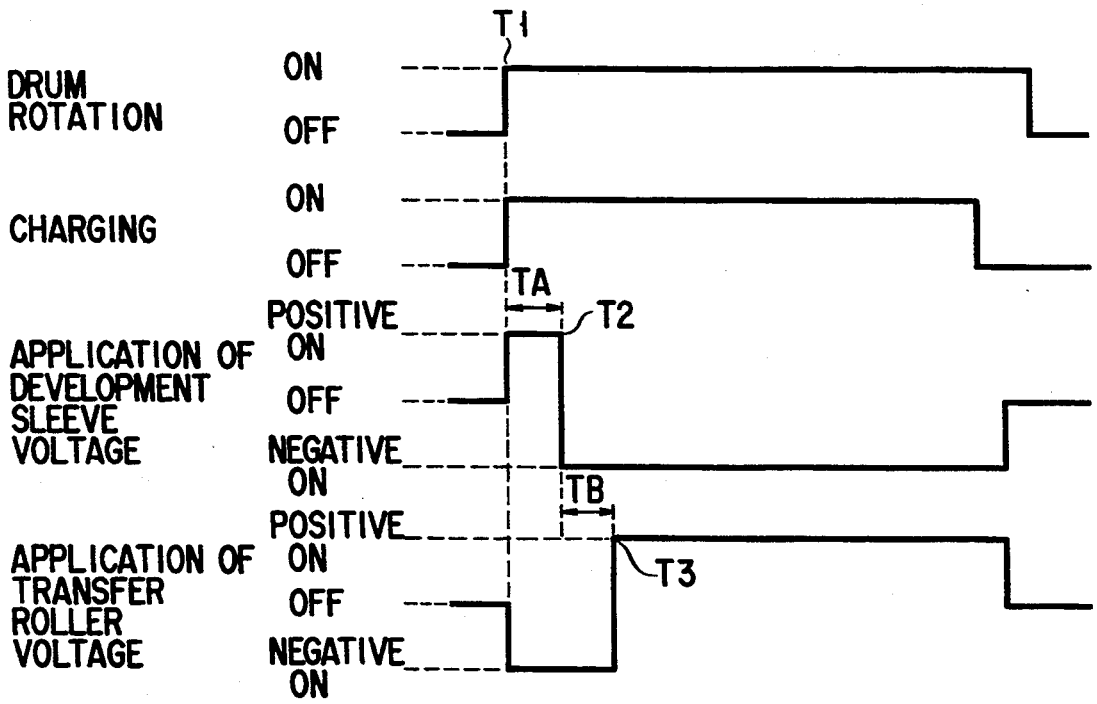
FIG. 8 is a timing chart of operation timings at primary portions of the electrophotographic printing apparatus of FIG. 7.

First, at the start of printing, the control section 16 permits the photosensitive drum driving system 7 to rotate the photosensitive drum 1. In response to this permission, the photosensitive drum driving system 7 starts to rotate the drum 1, which then begins to revolve (time T1 in FIG. 8).

The control section 16 also turns on the switch 23 of the charging device 2 at the same time that it gives the photosensitive drum driving system 7 a permission to rotate the drum 1. In the charging device 2, as soon as the switch 23 has been turned on, a high voltage generated by the high-voltage power supply 22 is applied to the discharging unit 21, which then discharges to cause the surface of the photosensitive drum 1 to be charged. At this time, the charged potential of the drum 1 is kept at a constant breakdown voltage of the zener diode 25 (at −500 V, in this case) by a combination of the grid 24 and Zener diode 25.

At time T1, the control section 16 also turns on the switch 141 of the development device 14 and the switch 151 of the transfer device 15. When these devices are not in operation, both the switches 44 and 141 of the development device 14 and the switches 53 and 151 of the transfer device 15 are in the OFF state. The switch 44 and switch 53 remain in the OFF state even after the switch 141 and switch 151 have been turned on. This permits a positive transfer voltage to be applied to the development sleeve 41 and a negative development bias to be applied to the transfer roller 51. With the development sleeve 41 applied with a positive voltage, negatively charged toner is electrostatically attracted to the development sleeve 41. With the transfer roller 51 applied with a negative voltage, even when some toner exists on the drum 1, there are no electrostatic forces that attract the toner to the transfer roller 51.

When a period of time TA has elapsed (time T2 in FIG. 8) since time T1, the control section 16 turns off the switch 141 and turns on the switch 44. That is, the voltage applied to the development sleeve 41 is changed from the positive transfer voltage to the negative development bias at the time when a particular point on the drum 1 positioned at charging position A at the start of charging reaches developing position B. This changeover starts a developing operation.

After another time of period TB has elapsed (time T3 in FIG. 8) since time T2, the control section 16 turns off the switch 151 and turns on the switch 53. That is, the voltage applied to the transfer roller 51 is changed from the negative development bias to the positive transfer voltage at the time when a particular point on the drum 1 positioned at charging position A at the start of charging reaches transferring position C. This changeover allows the generation of electrostatic forces that attract the toner adhering to the photosensitive drum 1 to the transfer roller 51, being ready for a transferring operation. From this point on, the printing operation is carried out according to the known electrophotographic processes as described in the first embodiment.

As with the third embodiment earlier described, with the present embodiment, a reverse bias is applied to the development sleeve 41 until the indefinite-potential portions on the drum 1 has passed developing position B, electrostatically attracting toner to the development sleeve 41. Accordingly, during the interval of the reverse bias, the development sleeve 41 is trapping toner effectively, preventing toner from adhering to the drum 1.

In this embodiment, because the transfer device 51 has the high-voltage power supply 52 that generates a transfer voltage of the opposite polarity to that of the charged potential of the drum 1 or that of the development bias, this power supply 52 is also used as a power supply to apply a reverse bias to the development sleeve 41, thereby achieving the lower production cost and the more compact, less-power consuming design of the apparatus. If the transfer voltage is not suitable for the development sleeve 41 or the development bias is not desirable for the transfer roller 51 (generally, the transfer voltage is higher than a voltage to be applied to the development sleeve 41), adjustment is necessary by, for example, adding a suitable resistor.

Because a development bias generated by the development bias power supply 43 continues to be applied to the transfer roller 51 until the indefinite-potential portions on the drum 1 have passed transferring position C, the toner adhering to the drum 1 can be prevented effectively and economically from adhering to the transfer roller 51, without providing an additional power supply.

The present invention is not limited to the previous embodiments. For instance, various requirements for the photosensitive drum 1, including the charged potential and the polarity, are not restricted to those used in the previous embodiments. The switching timings for applying a voltage to the selection sleeve 41 and to the transfer roller 51 are not restricted to those explained in the previous embodiments, but may be any timings as long as they are after time T2 for the applied-voltage switching timing with the development sleeve 41, and after time T3 for the applied-voltage switching timing with the transfer roller 51. It is desirable that the applied-voltage switching timing with the transfer roller 51 should be set taking into account the timing that the printing paper reaches transferring position C.

Although in the above embodiment, adhesion of toner to the transfer roller 51 is prevented by applying a development bias to the transfer roller 51, the application of development bias may be omitted provided that toner adhesion to the drum 1 at the development device 14 is sufficiently prevented or a noncontacting transfer unit such as a corona discharging unit is used. While in the embodiment, the transfer roller 51 is used, a brush, a belt, or a noncontacting type unit such as a corona discharging unit may be use.

The present invention may be practiced or modified in still other ways without departing from the spirit or essential character thereof.

A fifth embodiment of the present invention will be explained, referring to the accompanying drawings.

Figure 9:
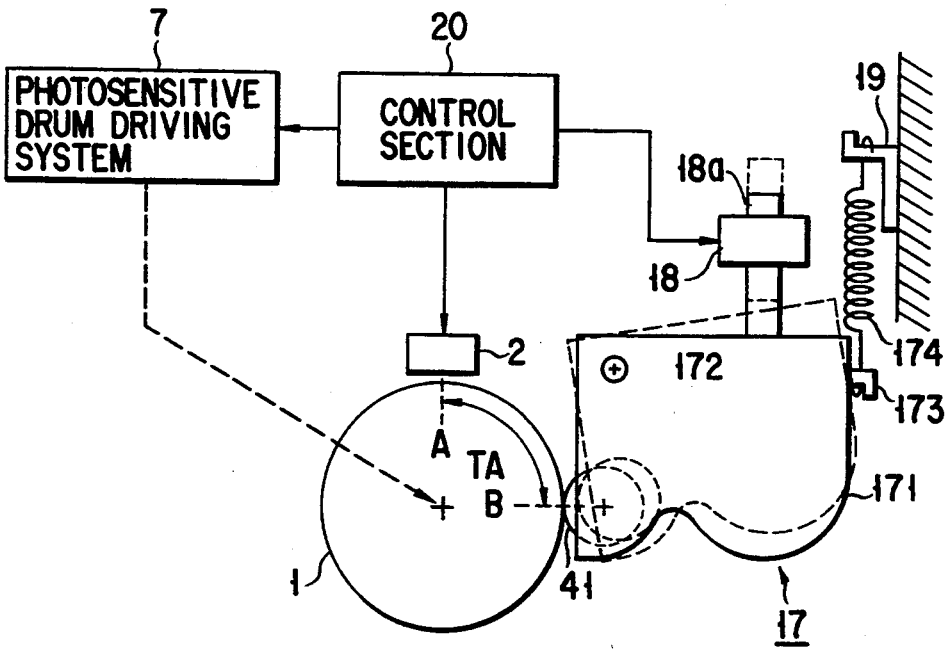
FIG. 9 is a schematic diagram of an electrophotographic printing apparatus according to a fifth embodiment of the present invention, centering on primary portions.
Figure 10:
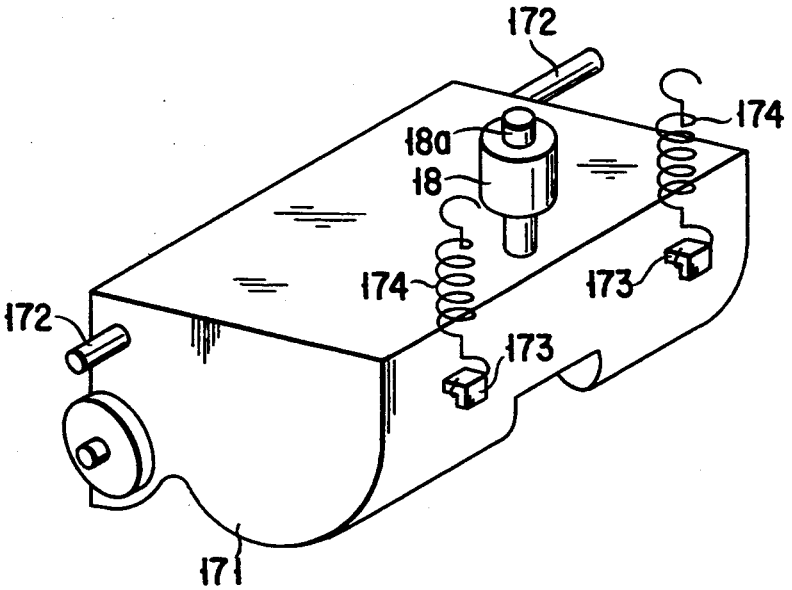
FIG. 10 is a perspective view of the electrophotographic printing apparatus of the fifth embodiment, centering on important portions.

FIGS. 9 and 10 are schematic diagrams of an electrophotographic printing apparatus of the fifth embodiment, centering on primary portions. FIG. 9 is the side view and FIG. 10 is the perspective view. The same parts as those in FIG. 1 are indicated by the same reference characters, and their detailed explanations will be omitted.

This electrophotographic printing apparatus is composed of a photosensitive drum 1, a charging device 2, a photosensitive drum driving system 7, a development device 17, a solenoid 18, a body plate 19, and a control section 20. Although it also contains an exposure device, a transfer device, and a cleaning device like the first embodiment, they are omitted in the figure.

The development device 17 is made up of a development sleeve 41, a hopper 171, a rotation instructing pin 172, a hook 173, and a spring 174. The hopper 171 stores toner. The development sleeve 41, a large proportion of which is located inside the hopper 171, is in contact with the toner stored in the hopper 171. The sleeve 41, a portion of which projects outside the hopper 171, carries the stored toner from the hopper 171 as it rotates. The projecting portion outside the hopper 171 of the sleeve 41 is very close to the photosensitive drum 1. The rotation instructing pin 172 is provided above the development sleeve 41 with its axis in parallel with that of the development sleeve 41. This pin 172 is installed in a body (not shown) so as to rotate freely. The hook 173 is installed on the side (the back end) of the hopper 171 from which the development sleeve is not projecting (hereinafter, referred to as the back end). One end of the spring 174 is hooked to the hook 173. The other end of the spring 174 is hooked to the body plate 19 secured to the not-shown body. The spring 174 pulls up the hook 173, that is, the back end of the hopper 171.

The solenoid 18 is fixed to the not-shown body so that a moving section **18*a* may be movable vertically. The solenoid 18 is also positioned so that the moving section 18*a* in the lower position may press down the back end of the hopper 171**.

The control section 20 supervises the starting timing for the photosensitive drum driving system 7 to rotate the drum 1, that for the charging device 2 to charge the photosensitive drum 1, and the up-and-down motion timings of the solenoid 18.

The operation of the electrophotographic printing apparatus thus constructed will be described in the order of control sequence of the control section 20. When the apparatus is not in operation, the moving section **18*a* of the solenoid 18 is in the upper position. In this state, the hopper 171 is being pulled up at its back end, tilting as shown by the broken lines in FIG. 9. Supported by the hopper 171, the development sleeve 41 moves as shown by the broken lines in FIG. 9, as the hopper 171 tilts. As a result of this motion, the development sleeve 41 is kept apart from the photosensitive drum 1**.

Figure 11:
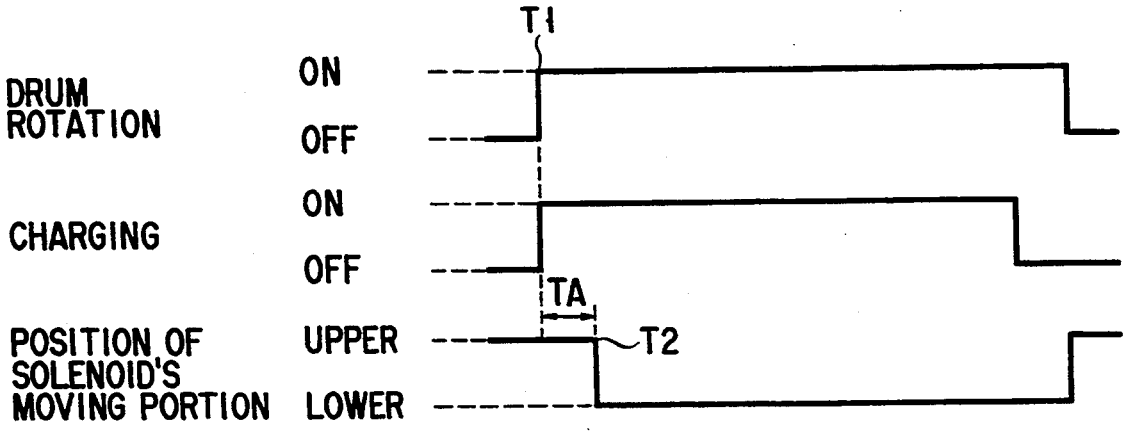
FIG. 11 is a timing chart of operation timings at major portions of the electrophotographic printing apparatus of FIG. 9.

In this state, to start a printing operation, the control section 20 first permits the photosensitive drum driving system 7 to rotate the photosensitive drum 1. In response to this permission, the photosensitive drum driving system 7 starts to rotate the drum 1, which then begins to revolve (time T1 in FIG. 11).

The control section 20 also turns on the switch 23 of the charging device 2 at the same time that it gives the photosensitive drum driving system 7 a permission to rotate the drum 1. In the charging device 2, as soon as the switch 23 has been turned on, a high voltage generated by the high-voltage power supply 22 is applied to the discharging unit 21, which then discharges to cause the surface of the photosensitive drum 1 to be charged. At this time, the charged potential of the drum 1 is kept at a constant breakdown voltage of the Zener diode 25 (at −500 V, in this case) by a combination of the grid 24 and Zener diode 25.

When a specified period of time TA (the time required for a particular point on the drum 1 to move from charging position A under the charging device 2 to developing position B under the development device 4) has elapsed (time T2 in FIG. 11) since time T1, the control section 20 energizes the solenoid 18 to move down the moving section 18*a*. That is, the moving section 18*a* of the solenoid 18 is moved downward at the time when a particular point on the drum 1 positioned at charging position A at the start of charging reaches developing position B. This downward movement causes the development sleeve 41 to move nearer to the photosensitive drum 1.

From this point on, the printing operation is carried out according to the known electrophotographic processes as described in the first embodiment.

As described above, with the present embodiment, because at the start of printing, the development sleeve 41 is kept apart from the drum 1 until the indefinite-potential portions on the drum 1 have passed developing position B, toner will not be supplied onto the drum 1 during this interval, thus preventing toner from adhering to the drum 1 even when the potential of the drum 1 is lower. Accordingly, a waste of toner can be avoided and the transfer roller be kept free from dirt.

The present invention is not restricted to the above embodiment. For instance, the mechanism for separating the development sleeve 41 from the drum 1 is not limited to than in the above-described embodiment. The present invention may be practiced or modified in still other ways without departing from the spirit or essential character thereof.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An electrophotographic printing apparatus comprising:

a photosensitive object having a conductive substrate and a photoconductive surface layer formed on said conductive substrate;

first rotating means for rotating said photosensitive object;

charging means, facing said photoconductive surface layer, for charging said photoconductive surface layer;

exposing means, facing said photoconductive surface layer, for partially exposing said photoconductive surface layer according to an image to be printed in order to form an electrostatic latent image on said photoconductive surface layer;

developing means for developing the electrostatic latent image to a developer image, the developing means including a developer retaining object, located facing said photoconductive surface layer, for retaining developer on a surface thereof and bringing the retained developer into contact with said photoconductive surface layer, second rotating means for rotating said developer retaining object, and first electric field generating means for generating a first electric field between said photosensitive object and said developer retaining object to cause said developer to partially adhere to said photoconductive surface layer according to said electrostatic latent image;

transferring means, facing said photoconductive surface layer, for transferring said developer image formed on said photoconductive surface layer to a specified printing medium;

second electric field generating means for generating a second electric field between said photosensitive object and said developer retaining object to attract said developer to said developer retaining object from said photoconductive surface layer; and control means for controlling said first rotating means, said developing means and said charging means to start charging said photoconductive surface layer when said first rotating means begins rotating said photosensitive object, and then to cause said second electric field generating means to generate said second electric field until a charging starting position on said photoconductive surface layer facing said charging means at the start of charging by said charging means has passed a position facing said developing means and to cause said first electric field generating means to generate said first electric field after said charging starting position has passed the position facing said developing means.

2. An electrophotographic printing apparatus according to claim 1, wherein:

said first electric field generating means comprises development bias power supply means for applying a specified development bias to said developer retaining object; and said second electric field generating means comprises reverse bias power supply means for applying to said developer retaining object a specified reverse bias of the opposite polarity to that of said development bias.

3. An electrophotographic printing apparatus according to claim 1, wherein said second electric field generating means comprises a bias power supply means for applying a specified bias voltage to the conductive substrate of said photosensitive object.

4. An electrophotographic printing apparatus according to claim 3, wherein:

said first electric field generating means comprises a development bias power supply means for applying a specified development bias to said developer retaining object; and said transferring means includes a transfer power supply for applying a transfer voltage to said printing medium to transfer the developer image on said photoconductive surface layer to said printing medium, the potential of said photoconductive surface layer charged by said charging means, said development bias, and said transfer voltage having values equal to values prevailing when the conductive substrate of said photosensitive object is grounded plus the bias voltage applied to the conductive substrate of said photosensitive object, respectively.

5. A method of electrophotographically printing comprising the steps of:

rotating a photosensitive object;

charging a photoconductive surface of the photosensitive object;

exposing selectively the photoconductive surface according to a document image to form an electrostatic latent image on the photoconductive surface;

developing the electrostatic latent image to a developer image;

transferring the developer image formed on the photoconductive surface to a printing medium at a transfer position;

starting charging the photoconductive surface when the photosensitive object has started rotating;

generating a first electric field for attracting developer to a developer retaining object from the photoconductive surface of the photoconductive object until the charging starting position of the photoconductive surface at which the charging is started has passed a developing position at which the developing is performed; and generating a second electric field for adhering developer to the latent image after a charging starting position of the photosensitive object at which the charging is started has passed a developing position at which the developing is performed.

6. A method of electrophotographically printing comprising the steps of:

rotating a photosensitive object;

charging a photoconductive surface of the photosensitive object;

exposing selectively the photoconductive surface according to a document image to form an electrostatic latent image on the photoconductive surface;

developing the electrostatic latent image to a developer image;

transferring the developer image formed on the photoconductive surface to a printing medium at a transfer position;

starting charging the photoconductive surface when the photosensitive object has started rotating;

generating a first electric field for attracting developer from the photoconductive surface of the photosensitive object to a developer retaining object until the charging starting position of the photosensitive object has passed a developing position at which the developing is performed;

generating a second electric field for adhering developer to the latent image after a charging starting position of the photosensitive object at which the charging is started has passed a developing portion at which the developing is performed;

generating a third electric field for preventing transfer of developer from the photoconductive surface at least until the charge starting position of the photosensitive object reaches the transfer position; and generating a fourth electric field for promoting transfer of the developer image from the photoconductive surface to the printing medium during the transferring step after the charging stating position of the photosensitive object reaches the transfer position.

7. An electrophotographic printing apparatus comprising:

a photosensitive object having a photoconductive surface;

first rotating means for rotating said photosensitive object;

charging means, facing said photoconductive surface, for charging said photoconductive surface;

exposing means, facing said photoconductive surface, for partially exposing said photoconductive surface according to an image to be printed in order to form an electrostatic latent image on said photoconductive surface;

developing means for developing the electrostatic latent image on said photoconductive surface to a developer image, said developing means including a developer retaining object, facing said photoconductor surface, for retaining developer on a surface thereof and bringing the retained developer into contact with said photoconductive surface, and second rotating means for rotating said developer retaining object;

first electric field generating means for generating a first electric field between said photosensitive object and said developer retaining object to cause developer to adhere to said photoconductive surface according to said electrostatic latent image;

transferring means facing said photoconductive surface;

second electric field generating means for generating a second electric field for transferring said developer image formed on said photoconductive surface to a printing medium;

third electric field generating means for generating a third electric field for inhibiting transfer of developer from said photoconductive surface to said transferring means; and control means for controlling said first rotating means, said charging means, said developing means and said first, second and third electric field generating means, to activate said developing means and said first electric field when a first period of time has elapsed from a time when said charging means started charging said photoconductive surface, the first period of time corresponding to a time period required for movement of said photosensitive object from a charging position at which said charging means charges said photoconductive surface to a developing position at which said developing means develops the electrostatic latent image on said photosensitive surface, to activate the second electric field when a second period of time has elapsed, the second period of time corresponding to a time period required for movement of said photoconductive object from the developing position, when the first time period elapses, to a transfer position at which said developer image transfers from said photoconductive surface to the printing medium, and to activate the third electric field during the first and second time periods.

8. An electrophotographic printing apparatus according to claim 7, wherein said control means includes:

means for generating a first control signal to said charging means to start charging said photoconductive surface, generating a second control signal to said second rotating means to start rotating said developer retaining object upon elapse of the first time period, generating a third control signal to activate the first electric field upon elapse of the first time period, generate a fourth control signal to activate the third electric field during the first and second time periods, and generate a fifth control signal to deactivate the third electric field and activate the second electric field upon elapse of the first and second time periods.

9. An electrophotographic printing apparatus comprising:

a photoconductive object including a conductive substrate and a photoconductive surface layer formed on the conductive surface and having a photoconductive surface;

means for translating the photoconductive surface in a closed loop path;

charging means for charging the photoconductive surface at a charging position;

exposing means for selectively exposing the photoconductive surface to form an electrostatic latent image on the photoconductive surface;

developing means including a developer retaining member for bringing developer into developing relation with the electrostatic latent image on the photoconductive surface at a developing position to form a developer image corresponding to the electrostatic latent image;

transfer means for transferring the developer image to a printing medium at a transfer position;

first and second power supplies;

switching means; and control means for controlling the translating means, charging means and switching means, whereby to initiate translation of the photoconductive surface past the charging position, developing position, and transfer position in succession, initiate charging of the photoconductive surface at the charging position by the charging means at a charge starting location on the photoconductive surface, condition the first power supply through the switching means to generate a first electric field between the photoconductive surface and the developer retaining member during a first time period required for the charge starting location on the photoconductive surface to at least move from the charging position to the developing position, the first electric field effective to attract developer from the photoconductive surface to the developer retaining member;

condition the second power supply through the switching means to generate a second electric field between the photoconductive surface and the transfer means during a second time period required for the charge starting location on the photoconductive surface to at least move from the charging position to the transfer position, the second electric field effective to inhibit transfer of developer from the photoconductive surface;

condition the second power supply through the switching means to generate a third electric field between the photoconductive surface and the developer retaining member upon expiration of the first time period, the third electric field effective to attract developer form the developer retaining member to the photoconductive surface and form a developer image conforming to the electrostatic latent image, and condition the first power supply through the switching means upon expiration of the second time period to generate a fourth electric field between the photoconductive surface and the transfer means, the fourth electric field effective to transfer the developer image from the photoconductive surface to the printing medium.

* * * * *

UNITED STATES PATENT AND TRADEMARK OFFICE

CERTIFICATE OF CORRECTION

PATENT NO. : 5,404,213

DATED : April 04, 1995

INVENTOR(S) : Yoshiaki OKANO et al.

It is certified that error appears in the above-indentified patent and that said Letters Patent is hereby corrected as shown below:

Claim 9, Column 22, Line 27, "form" should read --from--.

Signed and Sealed this

Fifteenth Day of August, 1995

Bruce Lehman

*Attest:*

BRUCE LEHMAN

*Attesting Officer*

*Commissioner of Patents and Trademarks*